US007171015B2

(12) United States Patent
Murayama et al.

(10) Patent No.: US 7,171,015 B2
(45) Date of Patent: Jan. 30, 2007

(54) SPEAKER APPARATUS

(75) Inventors: Kazuo Murayama, Kanagawa (JP); Kazuyuki Suda, Saitama (JP)

(73) Assignee: Sony Corporation (JP)

( * ) Notice: Subject to any disclaimer, the term of this patent is extended or adjusted under 35 U.S.C. 154(b) by 120 days.

(21) Appl. No.: 11/045,990

(22) Filed: Jan. 28, 2005

(65) Prior Publication Data

US 2005/0175212 A1 Aug. 11, 2005

(30) Foreign Application Priority Data

Feb. 6, 2004 (JP) ..... P2004-031188

(51) Int. Cl.
*H04R 25/00* (2006.01)

(52) U.S. Cl. ..... 381/404; 381/432

(58) Field of Classification Search ..... 381/404, 381/432, 403, 412, 413, 416; 181/171–173
See application file for complete search history.

(56) References Cited

U.S. PATENT DOCUMENTS

2002/0034315 A1* 3/2002 Auerbach et al. ..... 381/403
2002/0051558 A1* 5/2002 Kuze et al. ..... 381/404

* cited by examiner

*Primary Examiner*—Sinh Tran
(74) *Attorney, Agent, or Firm*—Lerner, David, Littenberg, Krumholz & Mentlik, LLP

(57) ABSTRACT

A speaker apparatus has a frame to which a convex paper is attached. A bobbin with a voice coil is attached to the paper cone. A magnetic circuit is formed inside the frame. A damper suspending the bobbin is composed of a corrugation portion, which is positioned orthogonal to the bobbin in an inactivity of the speaker apparatus. The damper also includes a first leg portion extending forward along a vibration direction of the bobbin from an inner periphery end of the corrugation portion, and a second leg portion extending backward along the vibration direction of the bobbin from an outer periphery end of the corrugation portion. The first and second leg portions have substantially the same length.

5 Claims, 3 Drawing Sheets

SPEAKER APPARATUS

BACKGROUND OF THE INVENTION

1. Field of the Invention

The invention relates to a speaker apparatus.

2. Related Art

A speaker apparatus utilizing cone paper as a diaphragm is called as "cone-type speaker apparatus". FIG. 1 is a partially cross-sectional diagram for illustrating a general configuration of a conventional cone-type speaker.

A speaker apparatus 51 comprises a frame 53 and cone paper 52 that is concavely installed to the frame 53. It also comprises a bobbin 55, which is positioned behind the cone paper 52, and a voice coil 54 wound to the bobbin 55. The bobbin 55 is suspended on the frame 53 by a damper 56.

It further comprises a yoke 57, a magnet 58, and a plate 59, which are composed of magnetic circuit and set behind the frame 53. They convert an electric signal applied to the voice coil 54 to a linear movement of the bobbin 55 so that the cone paper 52 can vibrate to sound.

The cone-type speaker apparatus may make the magnetic circuit smaller if the cone paper could vibrate by small magnetic flux. Therefore, the cone paper is made to be very thin so that it is as lightweight as possible. The cone paper is then shaped into cone to strengthen.

In the cone-type speaker apparatus, if a scale of the magnetic circuit is constant, in order to make the entire speaker apparatus thinner, the cone paper 52 may be made curved gently. Strength of the cone paper 5, however, deteriorates into a condition that a surface of the cone paper cannot uniformly vibrate, thereby generating distortion to make its sound quality deteriorated. Alternatively, if thick cone paper is used in order to strengthen it, the cone paper is made heavy weight, thereby causing its sound pressure to be decreased.

The damper 56 is used for suspending the bobbin 55 to which the voice coil 54 is attached. The damper 56 has an effect on reproduction capacity within a low frequency range in the speaker apparatus 51. In order to improve the reproduction capacity of the low frequency range, it is necessary to decrease its lowest resonant frequency, f0.

The lowest resonant frequency, f0 is represented as follows:

$$f0(\mathrm{Hz})=\tfrac{1}{2}\pi\sqrt{s0/m0}$$

where m0 (g) is effective mass in a vibration system such as the cone paper 52 and s0 (dyne/cm) is stiffness of vibration-member-suspending part(s) such as the damper 56.

If the effective mass m0 is constant, it is necessary to decrease the stiffness of the vibration-member-suspending part(s). The damper 56 and edge portion 52*a* are illustrated as the vibration-member-suspending parts. In general, the stiffness of the edge portion 52*a* is less than that of the damper 56, so that decreasing the stiffness of the damper 56 allows the reproduction capacity in the low frequency range to be improved.

When the entire conventional speaker apparatus 51 is made low-profiled, a distance between an adhered point A of the bobbin 55 and the cone paper 52 to which an end of the damper 56 is attached, and an attached surface B of the frame 53 to which the other end of the damper 56 is attached is not sufficiently gained.

In order to decrease the stiffness of the damper 56 to improve the reproduction capacity in the low frequency range, it is conceivable to make the damper 56 thinner. If making the damper 56 thinner, however, its strength deteriorates.

If the bobbin 55 is made higher, the damper 56 may be made longer, thereby decreasing the stiffness of the damper 56 so that f0 decreases. This prevents the entire speaker apparatus from becoming a low-profile one.

FIGS. 2A and 2B are partially cross-sectional diagrams each for illustrating a general configuration of a conventional cone-type speaker apparatus having a magnetic-proof system.

Conventionally, in order to have the cone-type speaker apparatus 51 provided with the magnetic-proof system, a cancel magnet 60 is set behind the yoke 57, as shown in FIG. 2A. Alternatively, a cover 61 is set to make a magnetic shield on the entire magnetic circuit, as shown in FIG. 2B.

Using the cancel magnet as shown in FIG. 2A causes the entire speaker apparatus to be made thicker. Using the cover 61 as shown in FIG. 2B causes a magnetic path to be formed, as shown by arrows therein, so that the magnetic flux is dispersed and sound pressure of the speaker is reduced.

In order to improve the above problems, it has been proposed that speaker apparatus, which is called as "reverse cone-type speaker apparatus", having the cone paper installed convexly is provided.

The reverse cone-type speaker apparatus can hold the frame portion low-profiled so that a low-profiled speaker can be implemented. It, however, makes the bobbin higher, thereby resulting in the cause in the bobbin's lateral vibration. This causes the voice coil to be contacted with the plate, thereby becoming worse in sound quality.

If the bobbin is made lower, it may prevent the bobbin from laterally vibrating. Since, however, the damper cannot be made longer, this avoids the reproduction capacity in the low frequency range and properties for input power handling being improved.

It is an object of the present invention to present a speaker apparatus having the cone paper installed convexly whereby even if the bobbin is made higher, it prevents the bobbin from vibrating laterally.

SUMMARY OF THE INVENTION

According to an aspect of the present invention, a speaker apparatus comprises a cone diaphragm, a frame for attaching the cone diaphragm convexly thereto, a bobbin attached to a top of the diaphragm, a voice coil attached to the bobbin, a magnetic circuit attached to the frame, and a damper for suspending the bobbin. In the speaker, the damper includes damping portion positioned orthogonal to the bobbin in a inactivity, a first leg portion extending forward along a vibration direction of the bobbin from an inner periphery end of the damping portion, and a second leg portion extending backward along the vibration direction of the bobbin from an outer periphery end of the damping portion. The first and second leg portions have same length to each other.

In this aspect of the present invention, an electric signal applied to the voice coil is converted into a linear movement of the bobbin in the speaker so that the diaphragm can vibrate to sound. The damper suspending the bobbin has a symmetrical configuration as a damping member, thereby allowing the damper to suspend the bobbin so that the bobbin can move linearly when the bobbin is moving. This results in preventing the bobbin from vibrating laterally.

Thus, the damper suspending the bobbin has a symmetrical configuration as a damping member, thereby allowing the damper to suspend the bobbin so that the bobbin can move linearly when the bobbin is moving. This also results in preventing the bobbin from vibrating laterally if a reverse cone-type speaker apparatus having a higher bobbin is used. Therefore, such the speaker apparatus having the diaphragm installed convexly allows its directivity to be improved. Such the low-profiled reverse cone-type speaker apparatus permits its sound quality to be improved.

In this speaker apparatus, the damper is made longer, thereby allowing f0 to be decreased without any deterioration of strength of the damper. This permits good reproduction capacity in low frequency range to be obtained. Further, the damper is made longer so that a stroke of the diaphragm can be made longer, thereby improving its properties for input power handling.

Alternatively, according to another aspect of the invention, a magnetic circuit is formed inside the frame, thereby resulting in less leakage of magnetic field toward the outside. This permits a screen of television or the like to be made less in its sensitive to the magnetic field even if the speaker apparatus is positioned near the television or the like, which reduces a constraint for a position to be set of the speaker apparatus. The magnetic circuit is hard to be affected from any outside magnetic fields, thereby avoiding sound quality becoming worse.

The concluding portion of this specification particularly points out and directly claims the subject matter of the present invention. However, those skill in the art will best understand both the organization and method of operation of the invention, together with further advantages and objects thereof, by reading the remaining portions of the specification in view of the accompanying drawing(s) wherein like reference characters refer to like elements.

DETAILED DESCRIPTION OF PREFERRED EMBODIMENTS

Figure 1:
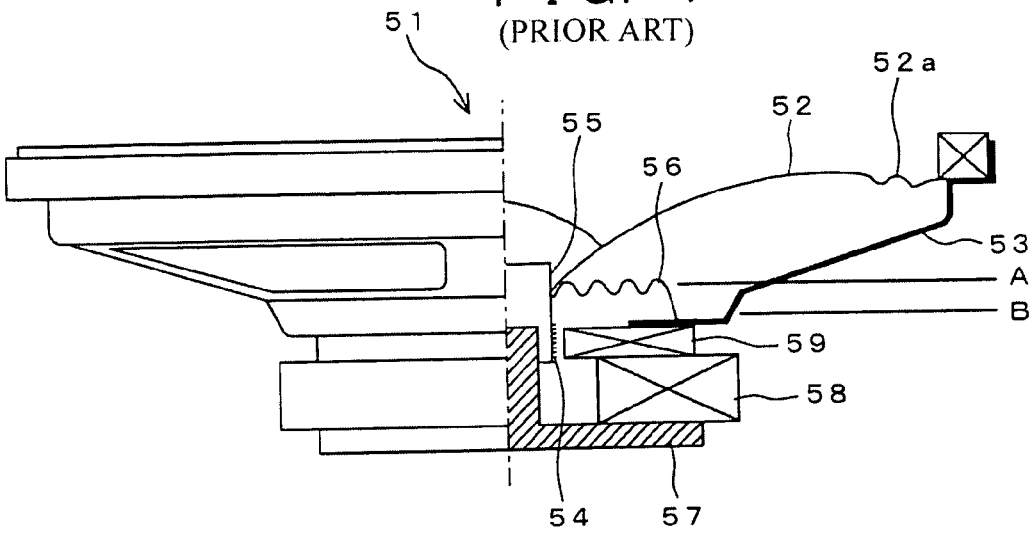
FIG. 1 (PRIOR ART)
FIG. 1 is a partially cross-sectional diagram for illustrating a general configuration of a conventional cone-type speaker.

Referring to the drawings, the invention will now be described in detail with reference to preferred embodiments of a speaker apparatus according to the invention.

Figure 3:
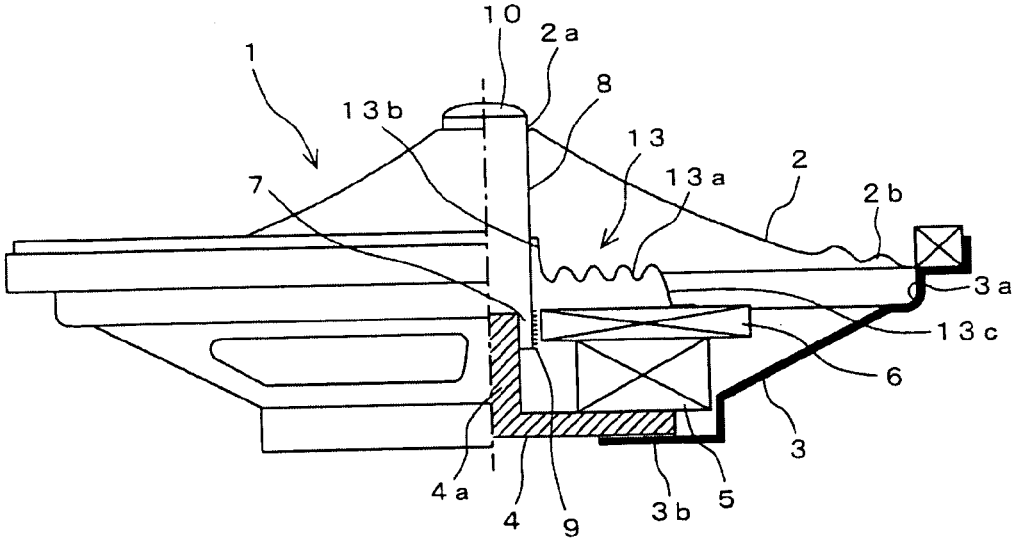
FIG. 3 is a partially cross-sectional diagram for illustrating a configuration of an embodiment of a speaker apparatus according to the invention.
Figure 2A:
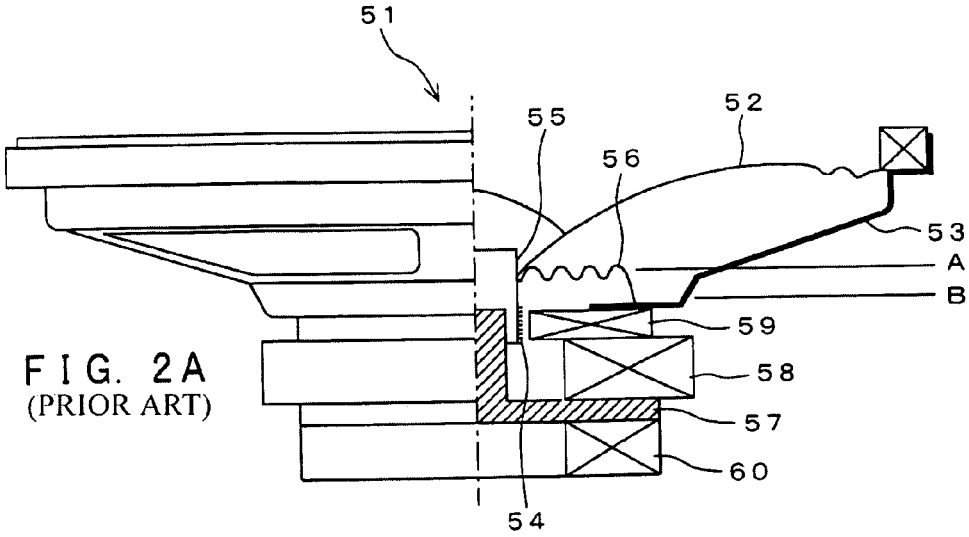
FIG. 2A (PRIOR ART)
FIGS. 2A and 2B are partially cross-sectional diagrams each for illustrating a general configuration of a conventional cone-type speaker having magnetic-proof system.
Figure 2B:
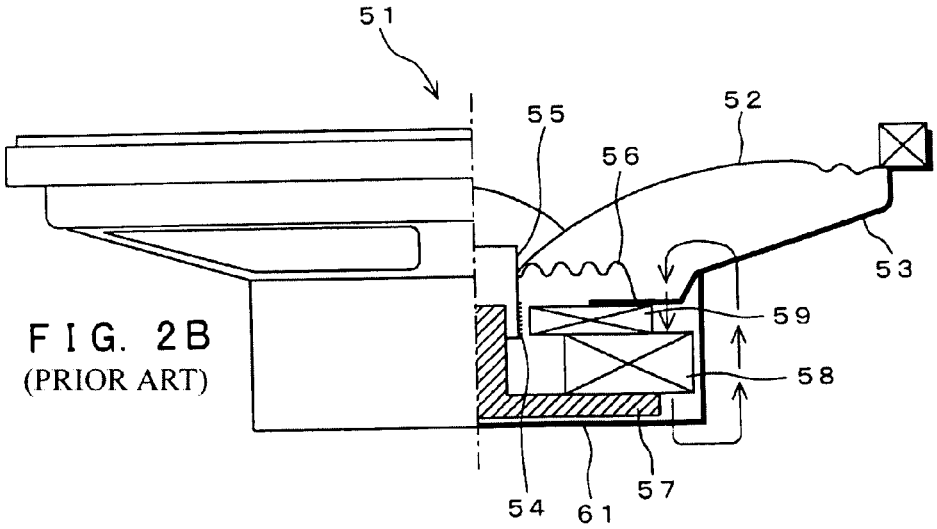
FIG. 2B (PRIOR ART)

FIG. 3 illustrates a configuration of an embodiment of the speaker apparatus according to the invention. The speaker apparatus 1 is cone-type speaker apparatus in which a yoke 4, a magnet 5, and a plate 6 are provided inside a frame 3 suspending cone paper 2. The cone paper 2 is included in a diaphragm and has a cone shape with a circular opening at a top 2*a* thereof. The cone paper 2 has an edge 2*b* on the periphery thereof. A surface from the top 2*a* to the edge 2*b* is configured so that it can be inclined and curved. The edge 2*b* of the cone paper 2 is adhered to the frame 3 with the top 2*a* projecting forward. Note that when attaching the cone paper 2 thereto with it having the above-mentioned direction, the surface is inclined and curved so that it is looked as being concave as viewed from the front of the speaker apparatus 1.

Thus, the cone paper 2 is attached to the frame 3 so that it can cover an opening portion 3*a* that is formed in the frame 3 at the front thereof. The cone paper 2 is adhered to the frame 3 with the top 2*a* thereof projecting forward, thereby forming a space between the opening portion 3*a* and a bottom 3*b* of the frame 3.

The magnetic circuit comprising the yoke 4, the magnet 5, and the plate 6 is provided inside the space, thereby allowing the frame 3, which supports the cone paper 2, to exercise a function of magnetic shield.

The yoke 4 is adhered to a bottom 3*b* of the frame 3. The yoke 4 has, at a center thereof, a pole piece 4*a* projecting forward. A magnet 5 is adhered to the front of the yoke 4 and the plate 6 is adhered to the magnet 5.

Thus, the magnet 5 and the plate 6 are positioned around the pole piece 4*a* so that a gap 7 is formed between an outer peripheral surface of the pole piece 4*a* and an inner peripheral surface of the plate 6.

A bobbin 8 is attached to the cone paper 2. The bobbin 8 has a configuration of cylinder and a forward end portion thereof is fitted into the top 2*a* of the cone paper 2 and adhered and fixed to the cone paper 2. The bobbin 8 extends from a back of the cone paper 2 toward the frame 3 and has a voice coil 9 attached thereto at a rear end thereof.

The rear end of the bobbin 8 is inserted into the gap 7 so that the voice coil 9 is positioned opposite the plate 6.

Note that the speaker apparatus 1 has an input terminal, not shown, at the frame 3 wherein a lead line of the voice coil 9 and the input terminal are connected with each other by a flexible wire.

A center cap 10 is attached to a front end of the bobbin 8. The center cap 10 closes an opening that is formed at the front end of the bobbin 8. This prevents the bobbin 8 from being mechanically transformed in a radial direction thereof, thereby avoiding mechanical transformation of the cone paper 2 in the radial direction thereof. This also shelters the voice coil 9 from intrusion of dust.

Figure 4:
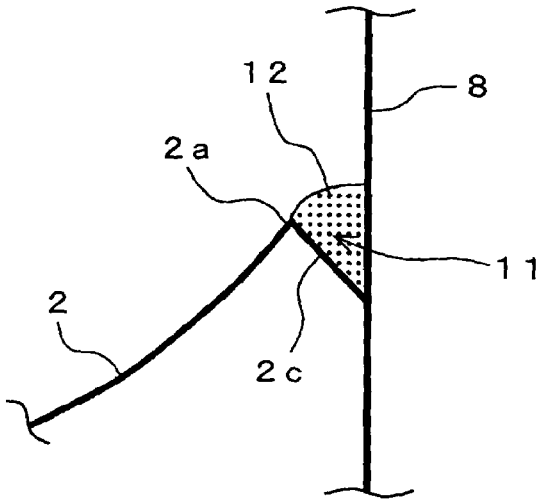
FIG. 4 is a sectional partially schematic illustration for illustrating an example of an attachment of cone paper to a bobbin.

FIG. 4 is a sectional partially schematic illustration for illustrating an example of an attachment of the cone paper 2 to the bobbin 8. The cone paper 2 is provided with a folded portion 2*c* that is formed by folding the cone paper 2 rearward at the top 2*a*. The bobbin 8 is fitted into the opening formed at the top 2*a* of the cone paper 2, so that an almost V-shaped groove 11 for filling adhesive can be formed between an outer periphery surface of the bobbin 8 and the folded portion 2*c* of the cone paper 2 along the peripheral direction of the bobbin 8.

Fixing the cone paper 2 to the bobbin 8 by filling the adhesive 12 into the groove 11 allows the bobbin 8 to be fixed to the cone paper 2 using an adequate amount of adhesive 12. This strengthens adhesive of the bobbin 8 to the cone paper 2, thereby preventing the bobbin 8 from vibrating laterally to improve its sound quality.

Referring back to FIG. 3, the bobbin 8 is suspended via a damper 13. The damper 13 comprises a corrugation portion 13*a* having sectional wave shape, which forms a damping portion, a first leg portion 13*b* extending forward along a vibration direction of the bobbin 8 from an inner periphery end of the corrugation portion 13*a*, and a second leg portion 13*c* extending backward along the vibration direction of the bobbin 8 from an outer periphery end of the corrugation portion 13*a*.

A front end of the first leg portion 13*b* of the damper 13 is adhered to a position 8*a* of the bobbin 8 concerning its center of gravity. The second leg portion 13*c* of the damper 13 is adhered to a front surface of the plate 6.

Figure 5:
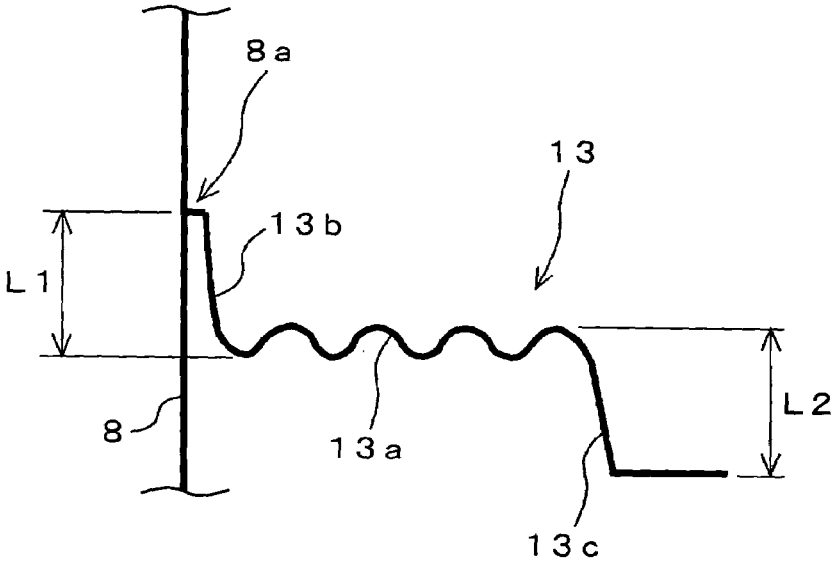
FIG. 5 is a sectional partially schematic illustration for illustrating a configuration of damper.

FIG. 5 is a sectional partially schematic illustration for illustrating a configuration of the damper 13. The damper 13 has a shape so that a length L1 of the first leg portion 13*b* of the damper 13 is the same as a length L2 of the second leg portion 13*c* of the damper 13. The corrugation portion 13*a* is positioned orthogonal to the bobbin 8 in an inactivity of the speaker apparatus 1.

Thus, the damper 13 has a symmetrical shape as a damping member to suspend the bobbin 8 so that it can move linearly. In general, the reverse cone-type speaker apparatus makes the bobbin higher, thereby facilitating the bobbin's lateral vibration. This causes the voice coil to be contacted with the plate, thereby becoming worse in its sound quality. In the embodiment of speaker apparatus 1 according to the invention, however, the above damper 13 suspends the bobbin 8 so that even if it makes the bobbin higher, the bobbin 8 is prevented from being vibrated laterally to move linearly.

The bobbin 8 moves linearly, thereby avoiding the voice coil 9 contacting with the pole piece 4*a* and/or the plate 6 to improve sound quality of the speaker apparatus 1.

Since the damper 13 has the first and second leg portions 13*b* and 13*c*, the damper 13 is made longer without making a diameter of the corrugation portion 13*a* larger.

As a result thereof, if a small speaker apparatus, the lowest resonant frequency, f0 can decrease without any deterioration of strength of the damper 13, thereby obtaining good reproduction capacity in the low frequency range. Further, making the damper 13 longer allows a stroke of the cone paper 2 to be made longer, thereby improving properties for input power handling.

Note that if a damper has a shape so that a length L1 of the first leg portion is not the same as a length L2 of the second leg portion, it has an asymmetrical shape so that a bobbin cannot be prevented from vibrating laterally, and move linearly. Failing to make the bobbin moved linearly results in contact of the voice coil with the pole piece and/or the plate so that its sound quality deteriorates.

The following will be described on operations of an embodiment of the speaker apparatus 1 according to the invention.

When applying an electric signal to the voice coil 9, magnetic flux passing through the gap 7 in the magnetic circuit composing of the yoke 4, the magnet 5, and the plate 6 makes the bobbin 8 vibrated according to an amplitude of the electric signal. The vibration of the bobbin 8 allows the cone paper 2 attached thereto to be vibrated to sound.

In the reverse cone-type speaker apparatus 1, the top 2*a* of the cone paper 2 projects forward so that its directivity can be improved. Further, in the embodiment of the speaker apparatus 1, the curved surface that can be also configured as the inclined surface of the cone paper 2 is curved so that it is looked as being concave as viewed from the front of the speaker apparatus 1, thereby improving its directivity of middle and high frequency ranges.

Since the space is formed between the cone paper 2 and the frame 3, the magnetic circuit is positioned inside the frame 3. This allows a leakage of magnetic field toward the outside to be reduced without providing with any cancel magnet and cover for magnetic shield. Further, the magnetic circuit is hard to be influenced from the outside magnetic field, thereby preventing deterioration of sound quality caused by a magnetic coupling even in an amplifier-built-in apparatus.

The following will be described on a flow of the magnetic flux if a polarity of the magnet 5 is set so that its side toward the yoke 4 is negative pole.

Magnetic flux from positive pole of the magnet 5 flows through the plate 6 and the voice coil 9 via the yoke 4 back to the negative pole of the magnet 5.

In this moment, the frame 3 becomes the negative pole via the yoke 4 while the frame 3 is prevented from contacting with the plate 6 so that a magnetic path is not formed via the frame 3. This avoids dispersion of the magnetic flux to improve sound pressure.

The invention has been described in detail with reference to specific embodiments of the invention in the form of the speaker apparatus 1, which can be formed using various kinds of materials forming the conventional speaker. This allows the speaker having a low-profiled configuration and a proof-magnetic structure with improved reproduction properties to be provided without increasing any costs therefor as compared with those of the conventional ones.

Thus, the embodiments of the speaker apparatus according to the invention is designed to make the speaker apparatus itself low-profiled without causing any deterioration of sound, thereby applying the this invention to a speaker apparatus in a flat panel display such as a liquid crystal display as well.

It should be understood that the invention is not limited to the embodiments and that the invention can be applied equally well to other types of speaker apparatuses. While the foregoing specification has described preferred embodiment(s) of the present invention, one skilled in the art may make many modifications to the preferred embodiment without departing from the invention in its broader aspects. The appended claims therefore are intended to cover all such modifications as fall within the true scope and spirit of the invention.

What is claimed is:

1. A speaker apparatus comprising:

a cone diaphragm;

a frame having the cone diaphragm convexly attached thereo;

a bobbin attached to a top of the cone diaphragm;

a voice coil attached to the bobbin;

a magnetic circuit attached to the frame; and a damper for suspending the bobbin, wherein the damper includes:

a damping portion positioned orthogonally to the bobbin in an inactivity period of the speaker apparatus;

a first leg portion extending forward along a vibration direction of the bobbin from an inner periphery end of the damping portion; and a second leg portion extending backward along the vibration direction of the bobbin from an outer periphery end of the damping portion; and wherein the first and second leg portions have substantially the same length.

2. The speaker apparatus according to claim 1, wherein the first leg portion of the damper is connected to a position of the bobbin substantially at a center of gravity of the bobbin.

3. The speaker apparatus according to claim 1, wherein the magnetic circuit is composed of a yoke, a magnet, and a plate and is positioned within a space formed between the frame and the diaphragm.

4. The speaker apparatus according to claim 1, wherein a top of the cone diaphragm and outer periphery surface of the bobbin form a groove for filing with adhesive therebetween.

5. The speaker apparatus according to claim 1, wherein a side of the diaphragm is composed of a concavely curved surface as viewed from a front of the speaker apparatus.

* * * * *